US009701038B1

(12) United States Patent
Moody

(10) Patent No.: US 9,701,038 B1
(45) Date of Patent: Jul. 11, 2017

(54) AUTOMATIC CHAINSAW TENSIONING DEVICE

(71) Applicant: Andrew M. Moody, Chiefland, FL (US)

(72) Inventor: Andrew M. Moody, Chiefland, FL (US)

(73) Assignee: Remedy Technologies, LLC, Tallahassee, FL (US)

( * ) Notice: Subject to any disclaimer, the term of this patent is extended or adjusted under 35 U.S.C. 154(b) by 0 days.

(21) Appl. No.: 15/153,059

(22) Filed: May 12, 2016

Related U.S. Application Data

(62) Division of application No. 13/868,396, filed on Apr. 23, 2013, now Pat. No. 9,381,666.

(51) Int. Cl.
*B27B 17/14* (2006.01)
*B27B 17/02* (2006.01)

(52) U.S. Cl.
CPC ..... *B27B 17/14* (2013.01); *B27B 17/02* (2013.01); *Y10T 83/7226* (2015.04); *Y10T 83/7251* (2015.04)

(58) Field of Classification Search
CPC . Y10T 83/7226–83/7258; B27B 17/02; B27B 17/14
USPC ..... 30/381–387; 83/814–816
See application file for complete search history.

(56) References Cited

U.S. PATENT DOCUMENTS

| | | | | |
|---|---|---|---|---|
| 3,194,284 | A * | 7/1965 | Walker | B27B 17/14 30/386 |
| 3,390,710 | A | 7/1968 | Cookson et al. | |
| 3,636,995 | A | 1/1972 | Newman | |
| 4,486,953 | A | 12/1984 | Halverson | |
| 5,174,029 | A | 12/1992 | Talberg | |
| 5,533,432 | A | 7/1996 | Ornberg | |
| 6,311,599 | B1 | 11/2001 | Lindehall | |
| 6,345,447 | B1 | 2/2002 | Ronkko | |
| 6,539,832 | B1 | 4/2003 | Nilsson | |
| 7,287,330 | B1 | 10/2007 | Riha | |
| 9,381,666 | B1 * | 7/2016 | Moody | B27B 17/14 |
| 2010/0088905 | A1 | 4/2010 | Pellenc | |

(Continued)

FOREIGN PATENT DOCUMENTS

| | | | |
|---|---|---|---|
| GB | 2354481 | A | 3/2001 |
| WO | 2011155880 | A1 | 12/2011 |

*Primary Examiner* — Laura M Lee
(74) *Attorney, Agent, or Firm* — J. Wiley Horton

(57) ABSTRACT

An apparatus for automatically adjusting a chainsaw cutting element as the chainsaw cutting element lengthens during use due to thermal expansion includes an elongate flat bar circumscribed by the chainsaw cutting element, a motor for causing the chainsaw cutting element to rotate about the elongate flat bar, a motor housing for housing the motor and a cover housing secured to the motor housing for covering a proximal end of the elongate flat bar and a rotatably mounted sprocket gear that engages a proximal end of the chainsaw cutting element. The elongate flat bar has a first, fully retracted position, a second, fully extended position, and an infinite number of positions of adjustment therebetween. Bias members continuously urge the elongate flat bar to displace during saw operation in a proximal-to-distal direction from the first, fully retracted position to the second, fully extended position to maintain chain tension at all times.

6 Claims, 4 Drawing Sheets

(56) References Cited

U.S. PATENT DOCUMENTS

| | | | |
|---|---|---|---|
| 2011/0314682 | A1 | 12/2011 | Maag et al. |
| 2014/0106915 | A1 | 4/2014 | Kistler et al. |

* cited by examiner

AUTOMATIC CHAINSAW TENSIONING DEVICE

BACKGROUND OF THE INVENTION

1. Field of the Invention

This invention relates to chainsaws. More specifically, it relates to a tensioning device that eliminates downtime associated with tensioning of the chainsaw cutting element.

2. Brief Description of the Related Art

A chainsaw includes an elongate flat bar that is attached by two (2) bolts and two (2) nuts to the body of the saw. This pair of adjustment screws is known in the industry as the externally threaded studs that protrude from the chainsaw motor block. A cutting element in the form of a chain circumscribes the bar. The chainsaw is used in a locked down position, i.e., the elongate flat bar cannot move when the chain is rotating.

As the saw is used, the chain links wear and stretch over time due to thermal expansion. The operator has to stop the saw because such expansion loosens the cutting element relative to the fixed position elongate flat bar. If the chainsaw is operated after the cutting element has become loose, the operator is in danger of serious injury. A cutting element can become loose in as few as six (6) to eight (8) minutes. A job that requires hours of cutting is thus frequently interrupted as the operator stops the saw in order to tighten the chain.

The exact chain-tightening procedure may vary from saw to saw, but the operator typically has to loosen at least one cam or bolt and turn a screw that is normally on the front of the saw, thereby putting the operator's hands near a hot sharp link. After loosening the bolts or cam the operator has to set the correct tension of the elongate flat bar and cutting element and re-tighten the loosened elements, i.e., the elongate flat bar is loosened so that it can be displaced in a proximal-to-distal direction in order to re-tighten the chain. The proximal end of the chain wraps around a fixed position sprocket so the proximal-to-distal displacement of the elongate flat bar, followed by re-tightening of the elongate flat bar in its new position, provides the required re-tensioning so that saw operation can resume. The procedure is time-consuming for professional saw operators and even more time-consuming as well as problematic for most noncommercial operators.

There is a longstanding need in the art of chainsaws for a structure that would eliminate the problem of having to shut down a chainsaw every few minutes in order to adjust the tension of the cutting element/chain.

More particularly, there is a need for a structure that would automatically maintain the tension on the chain for the life of the chain so that no shut down time would be required until the chain is so worn it can no longer cut.

The needed structure would not only save time, it would prevent serious injuries that occur when an operator fails to tighten a cutting element in a timely manner.

However, in view of the art considered as a whole at the time the present invention was made, it was not obvious to those of ordinary skill in the field of this invention how a chainsaw could be modified to eliminate the need for frequent adjustments of the elongate flat bar.

BRIEF SUMMARY OF THE INVENTION

The long-standing but heretofore unfulfilled need for a chainsaw that can be operated safely in the absence of downtime for chain tension adjustment is now met by a new, useful, and nonobvious invention.

The novel structure allows the elongate flat bar of the chainsaw to be moved freely in a forward (proximal-to-distal) direction, i.e., away from the motor and motor housing during saw operation, thereby eliminating the problem of having to shut down the saw and adjust the tension of the chain every six (6) to eight (8) minutes. The tension stays the same for the life of the chain and no shut down time is required.

The novel apparatus for automatically adjusting a chainsaw cutting element as the chainsaw cutting element lengthens during use due to thermal expansion includes an elongate flat bar circumscribed by the chainsaw cutting element, a motor for causing the chainsaw cutting element to rotate about the elongate flat bar, a motor housing for housing the motor, and a cover housing secured to the motor housing for covering a proximal end of the elongate flat bar and a sprocket gear that is mounted on the output shaft of the motor and which engages a proximal end of the chainsaw cutting element.

The elongate flat bar has a first, fully retracted position, a second, fully extended position, and an infinite number of positions of adjustment therebetween. A novel biasing member urges the elongate flat bar to move in a proximal-to-distal direction as it displaces from the first, fully retracted position to the second, fully extended position. The proximal-to-distal displacement is movement away from the motor housing in a plane of the elongate flat bar.

A longitudinally-extending slot is formed in a proximal end of the elongate flat bar. An adjustment plate having a fixed position is secured or integrally formed with the cover housing in parallel relation to the proximal end of the elongate flat bar. A flat spacer plate is disposed between the adjustment plate and the elongate flat bar and is secured in a fixed position relative to the adjustment plate.

A spacer plate pin is secured to the flat spacer plate in normal relation thereto, i.e., the spacer plate pin extends into the longitudinally-extending slot formed in the flat elongate bar. The spacer plate pin is disposed in a distal end of the longitudinally-extending slot when the elongate flat bar is in its fully retracted position, i.e., when the chainsaw cutting element is new and has not undergone thermal expansion.

The spacer plate pin is disposed in a proximal end of the longitudinally-extending slot when the elongate flat bar is in its fully extended position, i.e., when the chainsaw cutting element is fully thermally expanded due to extensive use.

A displacement aperture is formed in the proximal end of the elongate flat bar. A displacement pin is disposed normal to the plane of the elongate flat bar, i.e., the displacement pin extends into the displacement aperture, thereby engaging the elongate flat bar so that displacement of the displacement pin causes simultaneous and corresponding displacement of the elongate flat bar.

The displacement pin is biased by the biasing member to travel in a proximal-to-distal direction so that as the chainsaw cutting element undergoes thermal expansion during use, the displacement pin travels in a proximal-to-distal direction and carries the elongate flat bar in said proximal-to-distal direction as thermal expansion takes place, thereby continually tightening the chainsaw cutting element relative to said elongate fat bar.

A mounting plate is secured to the cover housing in overlying relation thereto and an upper block is fixedly secured to an upper end of the mounting plate. A lower block is positioned below the upper block but is not connected to the mounting plate.

A pair of high tension springs is disposed between the upper block and the lower block. A spring guide rod is ensleeved by a first spring of the pair of springs and a compression rod is ensleeved by a second spring of the pair of springs.

The spring guide rod has an upper end received within and secured to a first vertical bore formed in the upper block so that the spring guide rod cannot rotate about its longitudinal axis. The spring guide rod has a lower end slideably received within a first vertical bore formed in the lower block. The first vertical bores are in axial alignment with one another.

The compression rod has an externally threaded upper end extending through and slideably received within a second vertical bore formed in the upper block and has a lower end received within and secured to a second vertical bore formed in the lower block so that the compression rod cannot rotate about its longitudinal axis. The second vertical bores are in axial alignment with one another.

A compression tool engages the threaded upper end of the compression rod. The compression tool engages the external threads at the upper end of the compression rod and causes the lower block to travel toward the upper block as the compression tool rotates about its longitudinal axis of rotation and bears against the top surface of the upper block. The compression rod is unable to rotate about its longitudinal axis due to its lower end being fixedly secured to the lower block but the compression rod can be displaced along its longitudinal axis because its upper end is slideably received within the second vertical bore formed in the upper block. The upper block cannot move because it is fixedly secured to the mounting plate so the compression rod is therefore forced to travel upwardly along its longitudinal axis in response to rotation of the compression tool. The resulting upward travel of the lower block toward the upper block causes compression of both springs of the pair of springs.

A longitudinally-extending mounting plate slot is formed in the mounting plate and in the cover housing.

A displacement pin housing is provided from which the displacement pin depends in normal relation thereto.

An elongate control arm has a control aperture formed in a proximal end thereof and the displacement pin housing is secured to a distal end of the elongate control arm.

A cam is pivotally mounted to the mounting plate so that a top edge of the cam abuts a bottom surface of the lower block. The cam has a fully retracted, unpivoted position when the springs are fully compressed and has a fully extended, pivoted position when the springs are unloaded. The springs are fully compressed, and the elongate flat bar is in its most proximal position, when a new chain is installed and the springs are fully extended, and the elongate flat bar is in its most distal position, when a chain has reached the end of its working lifetime, i.e., when it is fully thermally expanded and its cutting teeth are worn and can no longer cut.

An angle iron or equivalent structure has a first end pivotally mounted to the mounting plate and an angle iron slot is formed in a second, lower end of the angle iron. In a direction leading into the plane of the paper, a control pin extends through an aperture formed in an angle iron square slide plate, the angle iron slot, the mounting plate slot, the cover plate slot, and through the control aperture formed in the proximal end of the elongate control arm. In the opposite direction, the control pin extends from the control aperture formed in the proximal end of the control arm, through the cover plate slot, the mounting plate slot, through the angle iron slot and through the aperture formed in the angle iron square slide plate. The end of the control pin that extends through the aperture formed in the angle iron square slide plate is captured by a cotter pin as depicted or by any other suitable means. The angle iron has a fully retracted, unpivoted position when the control pin is positioned at a proximal end of the mounting plate slot, i.e., when the springs are fully compressed and has a fully extended, pivoted position when the control pin is positioned at a distal end of the mounting plate slot, i.e., when the springs are fully expanded.

The cam has a lobe that abuts the angle iron when the springs are fully compressed, when the springs are fully unloaded, and at all spring compressions therebetween.

The control arm, the control pin, the displacement pin housing at the distal end of the control arm, and the displacement pin and hence the elongate flat bar are fully retracted when the springs are fully compressed and fully extended when the springs are fully expanded.

The displacement pin is displaced in a proximal-to-distal direction by proximal-to-distal displacement of the control pin. The proximal-to-distal displacement of the control pin is caused by pivoting of the angle iron and such pivoting is caused by pivoting of the cam as the springs expand and drive the lower block downwardly due to thermal-related lengthening of the cutting element/chain.

A longitudinally-extending slot is formed in the adjustment plate. In a direction from below or into the plane of the paper, toward the plane of the paper, a longitudinally spaced apart pair of adjustment screws extend through two (2) apertures, respectively, formed in a factory-built oiler plate, through the slot formed in the elongate flat bar, through a pair of apertures formed in the spacer plate, and through a pair of apertures formed in the adjustment plate. A pair of nuts respectively screwthreadedly engage the pair of adjustment screws so that when the nuts are tightly secured, the elongate flat bar is held against movement, i.e., the nuts have a first fully tightened position that locks the elongate flat bar against movement. The nuts have a second position where the nuts are backed off about half to three-quarters of a turn from the fully tightened position. The elongate flat bar is then free to longitudinally displace in a proximal-to-distal direction as urged by the biasing member as the chainsaw cutting element expands under thermal expansion.

An anti-rotation plate is disposed between the pair of nuts when the nuts are in the second, loosened position so that the nuts cannot rotate from the second position.

An anti-rotation pin formed integrally with the spacer plate has a free end disposed in the elongate slot formed in the elongate flat bar.

A second embodiment employs a single spring and a ratchet and pawl arrangement but works on the same principle of applying a continuous proximal-to-distal bias against the elongate flat bar and hence the chainsaw cutting element.

An important object of the invention is to eliminate the down time required to adjust a chain saw cutting chain as the links wear.

A more specific object is to provide a novel biasing member that is initially compressed with a compression tool so that a bias is applied to the elongate flat bar and hence the chain without interruption so that the elongate flat bar and chain are continuously adjusted as the saw is operated.

Another object is to eliminate thousands of hours of downtime for commercial users.

A related object is to improve chainsaw safety for commercial and noncommercial users.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
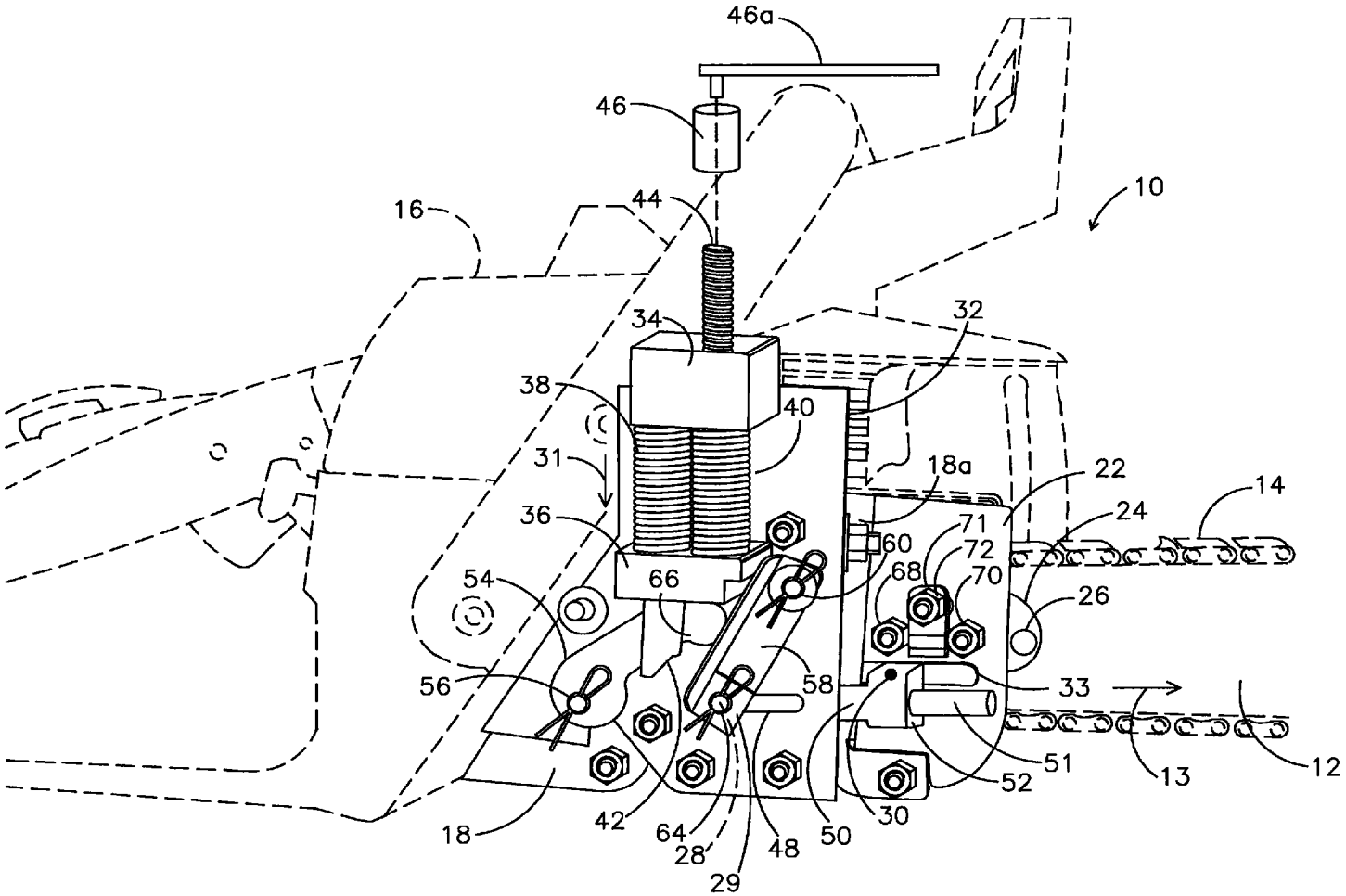
FIG. 1 is a perspective view of a first embodiment in its starting configuration, showing springs that are fully loaded.

A first embodiment of the novel apparatus for automatically adjusting a chainsaw cutting element as said chainsaw cutting element lengthens during use due to thermal expansion is denoted as a whole in the Figures by the reference numeral 10.

Elongate flat bar 12 is circumscribed by chainsaw cutting element 14. A motor, not depicted, causes cutting element 14 to rotate about elongate flat bar 12 in a well-known way.

Motor housing 16 houses the motor and cover plate 18 is secured to motor housing 16;

it covers a proximal end of elongate flat bar 12 and a rotatably mounted sprocket gear, not depicted, that engages a proximal end of cutting element 14.

Figure 2:
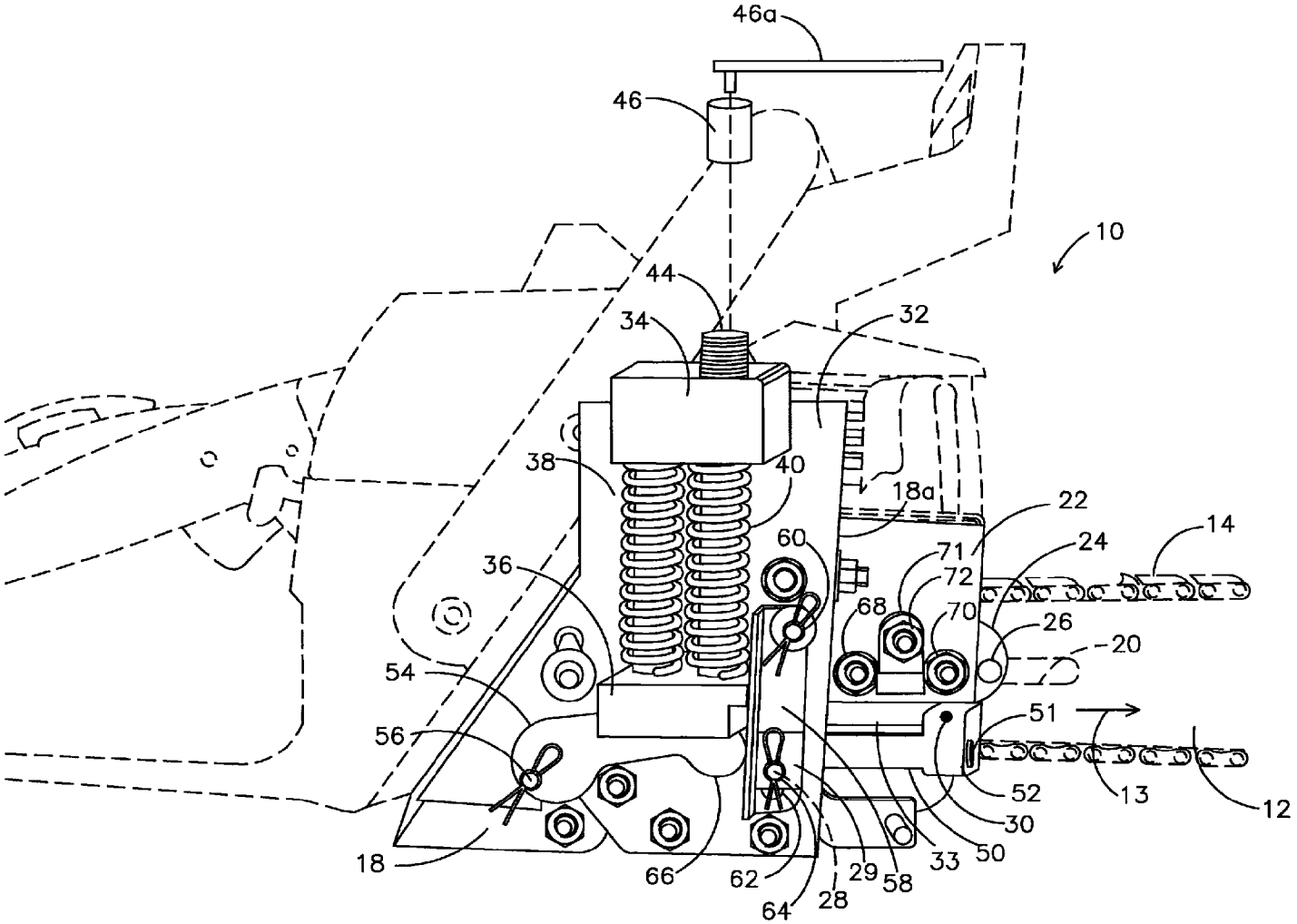
FIG. 2 is a perspective view of the first embodiment in its ending configuration, showing springs that are fully unloaded.
Figure 3:
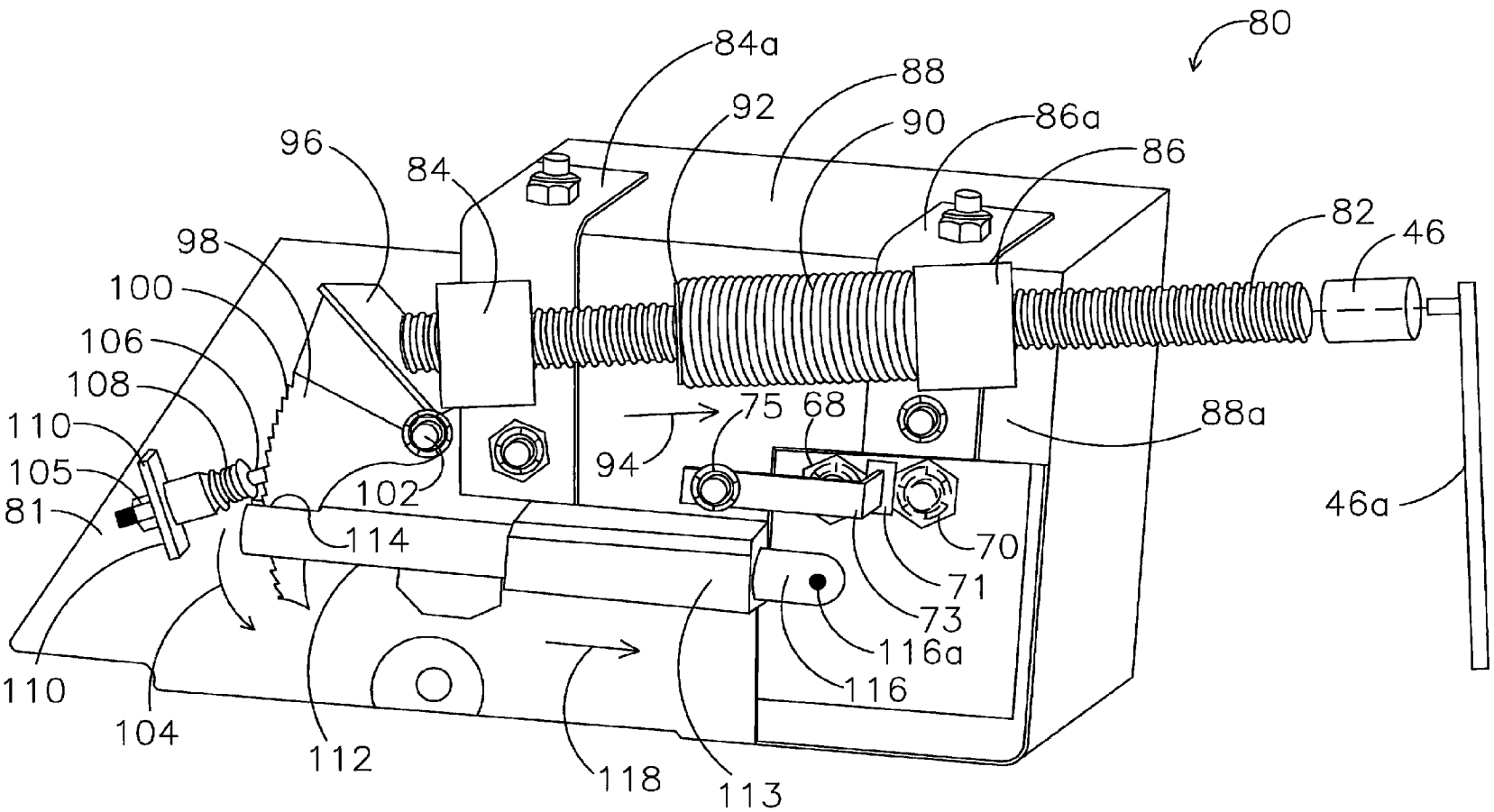
FIG. 3 is a perspective view of a second embodiment in its starting configuration, showing a spring that is fully loaded.
Figure 4:
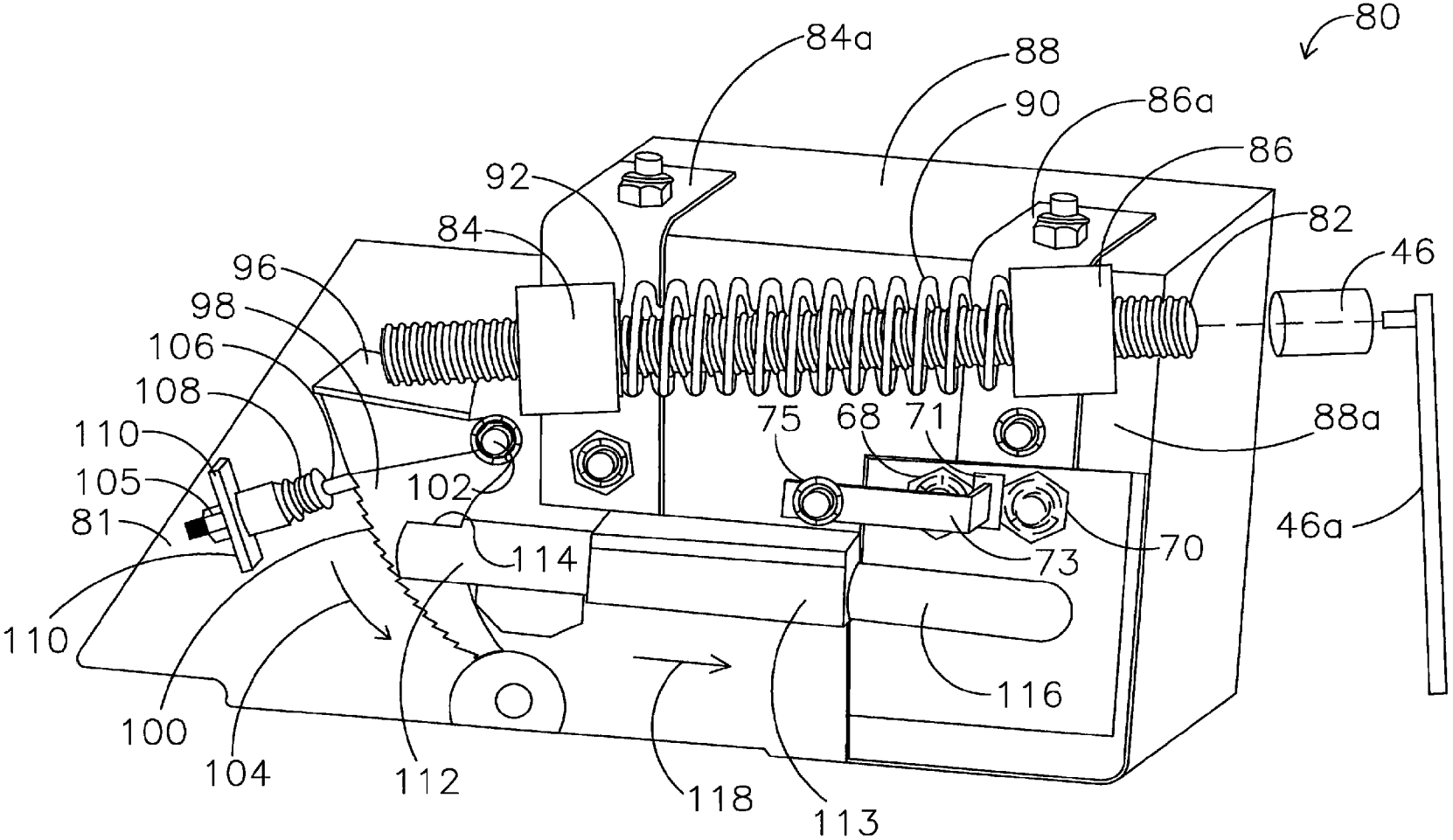
FIG. 4 is a perspective view of the second embodiment in its ending configuration, showing the spring fully unloaded.

Elongate flat bar 12 has a first, fully retracted position, a second, fully extended position, and an infinite number of positions of adjustment therebetween. The fully retracted position is depicted in FIGS. 1 and 3 and the fully extended position is depicted in FIGS. 2 and 4.

A biasing member, disclosed hereinafter, urges elongate flat bar 12 to move in a proximal-to-distal direction, denoted by directional arrow 13, as it displaces from its first, fully retracted position to its second, fully extended position. The proximal-to-distal displacement is movement away from motor housing 16 in the plane of elongate flat bar 12.

Longitudinally-extending slot 20 (FIG. 2) is formed in a proximal end of elongate flat bar 12 and is hidden from view in FIG. 1.

Adjustment plate 22 is secured to or integrally formed with cover plate 18 in closely spaced parallel relation to a proximal end of elongate flat bar 12 and has a fixed position. Step 18*a* is formed in cover plate 18 and interconnects cover plate 18 and adjustment plate 22. Step 18*a* is normal to cover plate 18 and adjustment plate 22 and extends into the plane of the paper. Flat spacer plate 24 is disposed between adjustment plate 22 and elongate flat bar 12. Flat spacer plate 24 is secured in a fixed position to adjustment plate 22.

Spacer plate pin 26 is secured to flat spacer plate 24 in normal relation thereto and extends into longitudinally-extending slot 20. Pin 26 is disposed in a distal end of slot 20 when elongate flat bar 12 is in its fully retracted position as depicted in FIG. 1, i.e., when chainsaw cutting element 14 is new and has not undergone thermal expansion. Pin 26 is disposed in a proximal end of slot 20 when elongate flat bar 12 is in its fully extended position as depicted in FIG. 2, i.e., when cutting element 14 is fully thermally expanded due to extensive use.

A control aperture is formed in a proximal end of elongate flat bar 12 and displacement pin 30 is disposed normal to the plane of elongate flat bar 12 and extends into said control aperture. Displacement pin 30 is biased by the biasing member to travel in a proximal-to-distal direction within elongate slot 33 formed in adjustment plate 22 so that as chainsaw cutting element 14 undergoes thermal expansion during use, displacement pin 30 travels in proximal-to-distal direction 13 and carries elongate flat bar 12 in said proximal-to-distal direction as said thermal expansion takes place.

Flat mounting plate 32 is secured to cover plate 18 in overlying relation thereto.

Upper block 34 is fixedly secured to an upper end of mounting plate 32. Lower block 36 is positioned below upper block 34 but is not connected to mounting plate 32.

A pair of high tension springs, denoted 38, 40, is disposed between upper block 34 and lower block 36.

Spring guide rod 42 is ensleeved by first spring 38 and compression rod 44 is ensleeved by second spring 40.

Spring guide rod 42 has an upper end received within and secured to a first vertical bore formed in upper block 34 so that it cannot rotate about its longitudinal axis. A lower end of spring guide rod 42 is slideably received within a first vertical bore formed in lower block 36. The first vertical bores are in axial alignment with one another.

Compression rod 44 has an externally threaded upper end extending through and slideably received within a second vertical bore formed in upper block 34. Compression rod 44 has a lower end received within and secured to a second vertical bore formed in lower block 36 so that it cannot rotate about its longitudinal axis. The second vertical bores are also in axial alignment with one another.

Compression tool 46 engages the threaded upper end of compression rod 44 and causes lower block 36 to travel toward upper block 34 as compression tool 46 rotates. Compression rod 44 is unable to rotate about its longitudinal axis due to its lower end being fixedly secured to lower block 36. Compression rod 44 is therefore forced to travel longitudinally in response to rotation of compression tool 46 which rotation causes said compression tool to urge upper block 34 downwardly; said upper block cannot displace downwardly so the reaction caused by compression tool 46 is the upward travel of compression rod 44 along its longitudinal axis. The travel of lower block 36 toward upper block 34 causes compression of springs 38, 40.

The leading end of compression tool 46 has a centered internally threaded bore with ACME square load bearing threads that are machined and matched with the ACME external threads formed in compression rod 44. The trailing end of compression tool 46 preferably has a non-circular bore that is releasably engaged by the mating non-circular drive of a socket/ratchet wrench 46*a*. Of course, the compression tool trailing end could have any tool-engageable surface that enables rotation of the compression tool about its longitudinal axis of symmetry so that the internal threads formed in the leading end can be advanced relative to the external threads of compression rod 44.

Longitudinally-extending mounting plate slot 48 is formed in mounting plate 32 and in cover housing 18. Elongate control arm 50 has a control aperture formed in a proximal end thereof. Displacement pin housing 52, from which displacement pin 30 extends, is secured to a distal end of said elongate control arm. The proximal end of elongate control arm 50 is visible through mounting plate slot 48 in FIG. 1 but is not numbered in said slot to avoid cluttering the drawings.

Displacement pin housing 52 is apertured so that it can slide relative to displacement housing guide rod 51 that is mounted between mounting plate 32 and adjustment plate 22 in parallel relation to said plates. Displacement pin housing 52 follows a path of travel defined by displacement housing guide rod 51 when said displacement pin housing is displaced in a proximal-to-distal direction by said biasing member.

Cam 54 is pivotally mounted to mounting plate 32 so that a top edge of said cam abuts a bottom surface of lower block 36 as depicted. Accordingly, displacement of lower block 36 in the direction indicated by directional arrow 31 causes pivotal displacement of cam 54 about pivot point 56 in a clockwise direction as drawn in FIG. 1.

Cam 54 has a fully retracted, unpivoted position as depicted in FIG. 1 when springs 38, 40 are fully compressed and has a fully extended, pivoted position as depicted in FIG. 2 when said springs are fully extended.

Angle iron 58 has a first end pivotally mounted to mounting plate 32 as at 60. Angle iron slot 62 (hidden in FIG. 1, visible in FIG. 2) is formed in a second, lower end of angle iron 58 to prevent jamming when angle iron 58 is pivoted in a counterclockwise direction from its FIG. 1 position. In a direction from inside the plane of the paper to the plane of the paper, control pin 64 extends through control aperture 28 formed in the proximal end of elongate control arm 50, an undepicted slot formed in cover plate 18 in registration with mounting plate slot 48, mounting plate slot 48, angle iron slot 62, and through a central aperture formed in angle iron square sliding plate 29. Displacement of control pin 64 in the proximal-to-distal direction thus effects simultaneous and corresponding displacement of displacement pin 30 and elongate flat bar 12. The novel biasing member prevents movement of control pin 64, displacement pin 30 and elongate flat bar 12 in a distal-to-proximal direction at all times.

Angle iron 58 has a fully retracted, unpivoted position when control pin 64 is positioned at a proximal end of mounting plate slot 48 when springs 38, 40 are fully compressed. Angle iron 58 has a fully extended, pivoted position when control pin 64 is positioned at a distal end of mounting plate slot 48 when springs 38, 40 are fully expanded.

Cam 54 has lobe 66 that abuts angle iron 58 when springs 38, 40 are fully compressed, when said springs are fully unloaded, and at all spring compressions therebetween.

Control pin 64, control arm 50, displacement pin housing 52, displacement pin 30 and elongate flat bar 12 have a fully retracted position when springs 38, 40 are fully compressed as depicted in FIG. 1 and have a fully extended position when said springs are fully expanded.

Control pin 64 and displacement pin 30 are displaced in proximal-to-distal direction 13 by counterclockwise pivotal rotation of angle iron 58.

The pivotal displacement of angle iron 58 is caused by pivoting of cam 54 as springs 38, 40 expand.

Spring expansion is caused by thermal-related lengthening of cutting element/chain 14.

Longitudinally-extending slot 20 is formed in elongate flat bar 12 as mentioned above. Longitudinally spaced apart adjustment screws extend through slot 20 and are respectively engaged by nuts 68, 70 so that when said nuts are tightly secured, elongate flat bar 12 is held against movement. The nuts are depicted but not numbered to avoid cluttering of the drawings.

The nuts having a first fully tightened position that locks elongate flat bar 12 against movement. The nuts have a second position where they are backed off about half to three-quarters of a turn from said fully tightened position. Elongate flat bar 12 is free to longitudinally displace in the proximal-to-distal direction indicated by directional arrow 13 when said pair of nuts is in the second, slightly loosened position but distal-to-proximal displacement is prevented by the novel biasing member at all times.

Nut 72 secures anti-rotation plate 71 against movement, said anti-rotation plate being disposed between nuts 68, 70 when said pair of nuts is in said second position so that said nuts cannot rotate from said second position.

Spacer plate 26 is also apertured to receive adjustment screws 68, 70.

An anti-rotation pin, not depicted, is formed integrally with spacer plate 26 and extends into elongate slot 20 formed in elongate flat bar 12 to prevent rotation of said elongate flat bar 12 in the plane of the paper as drawn.

When a new cutting element/chain 14 is secured in encircling relation to elongate flat bar 12, the trailing or proximal end of flat bar 12 is positioned to the left as drawn in FIG. 1. As saw 10 is operated and cutting element/chain 14 expands in length due to thermal expansion, elongate flat bar 12 is displaced further and further to the right in order to take up slack in cutting element/chain 14. Longitudinally-extending slot 20 enables elongate flat bar 12 to slide in a proximal-to-distal direction, denoted by directional arrow 13 as aforesaid, as the cutting element/chain 14 loosens and is continually re-tightened with the saw in operation.

Chain 14 reaches the end of its useful life, having been re-tensioned automatically during operation throughout its lifetime and never having been re-tensioned during a downtime.

A second embodiment, denoted 80 as a whole, is depicted in FIGS. 3 and 4.

Externally threaded elongate screw 82 extends through fixed position proximal block 84 and fixed position distal block 86. Said blocks 84 and 86 are secured to brackets **84*a* and 86*a*, respectively, that are secured to cover plate or housing 88 which is secured to motor housing 16, not depicted in FIGS. 3 and 4**.

Compression spring 90 is sandwiched between blocks 84 and 86 but its proximal end does not abut proximal block 84.

The proximal end of screw 82 extends through but does not engage a bore formed in proximal block 84.

The distal end of screw 82 extends through but does not engage a bore formed in distal block 86.

The proximal end of spring 90 abuts flat base plate 92 which has an unthreaded bore formed therein to slidably receive elongate screw 82. Flat base plate 92 is welded or otherwise fixedly secured to elongate screw 82.

Flat base plate 92 has a flat edge that slideably engages flat vertical surface **88*a* of cover housing 88 so that said flat base plate travels in a proximal-to-distal direction as indicated by directional arrow 94 when compression tool 46 engages the threaded distal end of elongate screw 82, said compression tool being rotated by ratchet/socket wrench 46*a*. This causes sliding displacement of flat base plate 92**.

Accordingly, spring 90 compresses as base plate 92 is drawn in said proximal-to-distal direction by rotation of compression tool 46 that engages the distal end of screw 82 and causes said flat base plate to travel in said direction. Screw 82 does not rotate about its longitudinal axis of symmetry.

The proximal end of screw 82 abuts ratchet base plate 96 which is formed integrally with ratchet main body plate 98 having teeth 100 formed along a curved proximal edge of said ratchet main body plate.

The position of ratchet base plate 96 depicted in FIG. 3 is its position of repose. As spring 90 unloads as cutting element 14 lengthens with use, elongate screw 82 and base plate 92 travel without rotation in a direction opposite to the direction indicated by directional arrow 94, i.e., in a distal-to-proximal direction. Ratchet base plate 96 therefore pivots about pivot point 102 in a counterclockwise direction as at 104.

Pawl 106 sequentially engages teeth 100, beginning away from the top of ratchet main body plate 98 as depicted in FIG. 3 and teeth 100 are sloped so that pawl 106 does not interfere with the counterclockwise rotation of ratchet main body plate 98. However, clockwise pivoting of ratchet main body plate 98 is prevented by said teeth.

Pawl 106 is spring-loaded as at 108. It is also provided with finger-grip handles 110 that enable a saw operator to pull pawl 106 out of engagement with teeth 100 by overcoming the bias of spring 108. Nylon lock nut 105 enables the position of handles 110 to be adjusted, thereby adjusting the bias of spring 108. Disengagement of pawl 106 from teeth 100 is needed only when a new chain is being installed at which time it is necessary to rotate ratchet base plate 96 from its fully rotated FIG. 4 position to its initial, unrotated position depicted in FIG. 3. The pawl assembly is welded to back plate 81 of the chainsaw housing. When the chainsaw operator pulls finger-grip handles 110, spring 108 is momentarily compressed and pawl 106 disengages from teeth 100. Release of handles 110 allows pawl 106 to re-engage teeth 100 under the bias of spring 108.

Elongate control arm 112 interconnects ratchet main body plate 98 and elongate flat bar 12, not depicted in FIGS. 3 and 4. Control slot 114 is formed in the proximal end of elongate control arm 112 and ratchet main body plate 98 is disposed within said control slot.

The distal end 116 of elongate control arm 112 has a ninety degree (90°) bend formed therein and includes displacement pin **116*a* that engages the displacement aperture, not depicted, formed in elongate flat bar 12**.

Elongate control arm 112 slideably extends through hollow guide housing 113 which is mounted in fixed relation to cover housing 88.

Displacement of ratchet main body plate 98, caused by pivoting of ratchet base plate 96 in a counterclockwise direction as drawn in FIG. 3, which in turn is caused by the expansion of spring 90 as base plate 92 and elongate screw 82 are displaced without rotation in a distal-to-proximal direction by the bias of spring 90, is thus simultaneously transmitted to elongate flat bar 12, i.e., as cutting element 14 lengthens under thermal expansion, compression spring 90 unloads, resulting in proximal-to-distal travel as at 118 of elongate control rod 112 and hence of elongate flat bar 12 just as in the first embodiment.

Nuts 68, 70 respectively engage the same adjustment screws as in the first embodiment and they are tightened fully and then backed off in the same way as disclosed in connection with the first embodiment. Anti-rotation plate 71 is positioned between the nuts as in the first embodiment for the same reason. Plate 71 is mounted to the end of "L"-shaped plate 73, said plate 73 being secured to cover housing 88 by suitable fastening means 75.

This second embodiment presents a more narrow profile than the profile of the first embodiment and has less weight than said first embodiment. It also uses one spring instead of two and eliminates the need for a cam and a pivotally mounted angle iron. It further eliminates the need for a longitudinally-extending slot formed in the mounting plate of the first embodiment into which a control pin is inserted.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. An apparatus for automatically adjusting an elongate flat bar on a chainsaw circumscribed by a chainsaw cutting element as said chainsaw cutting element lengthens during use, wherein said chainsaw has a motor and said chainsaw cutting element is adapted to rotate about said elongate flat bar, said apparatus comprising:

a motor housing adapted to house said motor;

a cover housing secured to said motor housing for covering a proximal end of said elongate flat bar;

said elongate flat bar having a first, fully retracted proximal position, a second, fully extended distal position, and an infinite number of positions of adjustment therebetween;

a biasing member for urging said elongate flat bar to move in a proximal-to-distal direction as said biasing member displaces from said first, fully retracted position to said second, fully extended position, said proximal-to-distal displacement being movement away from said motor housing in a plane of said elongate flat bar;

said biasing member including an elongate screw;

said biasing member further including a proximal block fixedly secured to said cover housing and having an unthreaded bore formed therein;

said biasing member further including a distal block fixedly secured to said cover housing in longitudinally spaced apart relation to said proximal block and having an unthreaded bore formed therein;

said elongate screw having a proximal end that slideably extend through said unthreaded bore formed in said proximal block;

said elongate screw having a distal end that slidably extends through said unthreaded bore formed in said distal block;

said biasing member further including a flat base plate having an unthreaded bore formed therein to receive said elongate screw, said flat base plate being welded to said elongate screw;

said flat base plate positioned between said proximal block and said distal block;

said biasing member further including an elongate spring, said elongate spring having a distal end that abuts said distal block and having a proximal end that abuts said flat, internally threaded base plate;

said flat, unthreaded base plate abutting said proximal block when said elongate spring is fully extended; and said flat base plate being spaced away from said proximal block when said elongate spring is compressed, said flat base plate being spaced a maximum distance from said proximal block when said elongate spring is fully compressed.

2. The apparatus of claim 1, further comprising:

said base plate having a surface that abuts said cover housing and slides but does not rotate relative to said cover housing;

a compression tool that rotatably engages the distal end of said elongate screw;

said elongate spring being compressed as said base plate is drawn in a proximal-to-distal direction by rotation of said compression tool that engages said distal end of said screw when said compression tool abuts said distal block;

said elongate screw and said base plate traveling in a distal-to-proximal direction without rotation as said elongate spring extends.

3. The apparatus of claim 2, further comprising:

a pivotally mounted ratchet base plate having an unrotated position or repose when said elongate spring is fully compressed;

said ratchet base plate having a fully rotated position when said elongate spring is fully extended;

said ratchet base plate being positioned on a proximal side of said proximal block in longitudinal alignment with said elongate screw so that distal-to-proximal travel of said elongate screw effect pivotal rotation of said ratchet base plate away from said position of repose.

4. The apparatus of claim 3, further comprising:

a ratchet main body plate is fixedly secured to and depends from said ratchet base plate;

a plurality of teeth formed in a proximal edge of said ratchet main body plate;

a pawl positioned adjacent said ratchet main body plate;

said pawl sequentially engaging said teeth, beginning at a first end of said ratchet main body plate, as said ratchet base plate is pivotally displaced by said elongate screw as said elongate spring extends; and said plurality of teeth being sloped so that said pawl allows the pivoting of said ratchet main body plate in a first direction and such that said pawl does interfere with and prevent pivoting of said ratchet main body plate in a second direction opposite to said first direction.

5. The apparatus of claim 4, further comprising:

said pawl being provided with handles that allow said pawl to be pulled out of engagement with said teeth by overcoming the bias of a spring that loads said pawl;

said pawl being pulled out of engagement with said teeth when a new chain is being installed;

said ratchet base plate being rotated from its fully rotated position to its initial, unrotated position of repose when said pawl is pulled out of engagement with said teeth.

6. The apparatus of claim 5, further comprising:

an elongate control arm for interconnecting said ratchet main body plate and said elongate flat bar;

a control slot formed in the proximal end of said elongate control arm;

a distal edge of said ratchet main body plate being disposed within said control slot so that the teeth formed in the proximal edge of said ratchet main body plate are in open communication with said pawl;

a displacement aperture formed in a proximal end of said elongate flat bar;

said elongate control arm having a ninety degree (90°) bend formed in a distal end of said elongate control arm;

a displacement pin extending from said distal end so that said displacement pin can engage said displacement aperture;

said ratchet main body plate being displaced by pivoting of said ratchet base plate in first direction, which pivoting is caused by expansion of said elongate spring as said ratchet base plate is pivotally displaced by the bias of said elongate spring;

said displacement of aid ratchet base plate being simultaneously transmitted to said elongate flat bar by said elongate control bar and said displacement pin as said cutting element lengthens under thermal expansion, which allows expansion of said elongate spring, said spring expansion resulting in proximal-to-distal travel of said elongate control rod.

* * * * *